US008353264B2

(12) United States Patent
Meintschel et al.

(10) Patent No.: US 8,353,264 B2
(45) Date of Patent: Jan. 15, 2013

(54) VALVE DRIVE ARRANGEMENT

(75) Inventors: Jens Meintschel, Bernsdorf (DE); Thomas Stolk, Kirchheim (DE); Alexander Von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 296 days.

(21) Appl. No.: 12/800,477

(22) Filed: May 14, 2010

(65) Prior Publication Data

US 2010/0242884 A1 Sep. 30, 2010

Related U.S. Application Data

(63) Continuation-in-part of application No. PCT/EP2008/008844, filed on Oct. 18, 2008.

(30) Foreign Application Priority Data

Nov. 17, 2007 (DE) ..... 10 2007 054 978

(51) Int. Cl.
*F01L 1/34* (2006.01)

(52) U.S. Cl. ..... 123/90.18; 123/90.6

(58) Field of Classification Search .... 123/90.15–90.18, 123/90.6

See application file for complete search history.

(56) References Cited

U.S. PATENT DOCUMENTS

| | | | | |
|---|---|---|---|---|
| 5,129,407 | A * | 7/1992 | Phillips | 123/90.18 |
| 5,289,806 | A * | 3/1994 | Hurr | 123/90.17 |
| 2010/0269769 | A1 * | 10/2010 | Schoeneberg et al. | 123/90.6 |

FOREIGN PATENT DOCUMENTS

| | | |
|---|---|---|
| DE | 101 48 177 | 4/2003 |
| DE | 101 48 178 | 4/2003 |
| EP | 0 579 592 | 7/1993 |
| GB | 10 648 | 0/1911 |
| JP | 52 044314 | 4/1977 |

* cited by examiner

*Primary Examiner* — Thomas Denion
*Assistant Examiner* — Daniel Bernstein
(74) *Attorney, Agent, or Firm* — Klaus J. Bach

(57) ABSTRACT

In a valve drive device, especially for an internal combustion engine including a camshaft with a cam element which is axially movably supported on the camshaft but in a rotationally fixed manner, the cam element includes a gate structure and an actuation device is provided with at least one shift element for engagement with the gate arrangement for axially displacing the cam element and the shift element has a rotationally asymmetrical basic shape in order to follow the gate structure when placed in engagement therewith.

7 Claims, 3 Drawing Sheets

VALVE DRIVE ARRANGEMENT

This is a Continuation-In-Part Application of pending international patent application PCT/EP2008/008844 filed Oct. 18, 2008 and claiming the priority of German patent application 10 2007 054 978.6 filed Nov. 17, 2007.

BACKGROUND OF THE INVENTION

The invention relates to a valve drive device, in particular of an internal combustion engine, including an operating mechanism with at least one shift element for axially displacing a cam element on a camshaft.

Valve drive arrangements, in particular of an internal combustion engine, with an actuation device which has at least one shift element for axially displacing a cam element by means of a shift gate, are already known.

It is the principal object of the invention to provide a valve drive arrangement, where a defined movement of a shifting element in the shift gate can be achieved.

SUMMARY OF THE INVENTION

In a valve drive device, especially for an internal combustion engine including a camshaft with a cam element which is axially movably supported on the camshaft but in a rotationally fixed manner, the cam element includes a gate structure and an actuation device is provided with at least one shift element for engagement with the gate arrangement for axially displacing the cam element and the shift element has a rotationally asymmetrical basic shape in order to follow the gate structure when placed in engagement therewith.

It is suggested that the shift element has a rotationally asymmetrical basic shape. A "basic shape" of the shift element is thereby especially meant to be a shape of the shift element in an area parallel to a surface of the gate path. The basic shape is preferably formed by a shape of an area, which serves as support area for a contact with the gate structure. A "rotationally asymmetrical basic shape" is thereby a basic shape which has a marked main axis, which can be determined in a defined manner and in particular independently of a position of the shift element. Preferably, the actuation element has a rotationally asymmetrical basic shape, chosen such that a defined movement of the shift element in the gate structure can be achieved in a simple manner.

It is further suggested that the shift element has a basic shape with a long main axis and a short secondary axis extending perpendicularly thereto. The shift element can thereby be guided in an advantageous manner, especially parallel to the main axis. The shift element is thereby preferably symmetrical with regard to the main axis.

In a further arrangement, it is suggested that the shift element has an essentially rectangular basic shape. An advantageous guide can also be achieved thereby, especially if the gate structure has a positive profile.

The shift element preferably has a guide recess, which is provided to be in engagement with the gate structure. A particularly exact guide and a particularly advantageous arrangement of the gate structure can be enabled thereby. The guide recess is preferably designed as a U-shaped guide groove, into which a segment of the gate structure which is preferably formed in a positive manner extends.

It is further suggested that the valve drive arrangement has a shift element fastening device, by which the shift element is rotatably supported on to a fastening actuator. A canting of the shift element, in particular in gate structure areas with an axial-direction component, can thereby be avoided.

The valve drive arrangement has advantageously at least one guide collar, which is provided to guide the shift element. The shift element can thereby be guided in an advantageous manner, and a rotation of the shift element relative to the actuator can be avoided when the shift element is disengaged from the gate structure.

The shift element is preferably provided to move the cam element in the two opposite directions. A further shift element can thereby be foregone, whereby the valve drive arrangement can be a very compact.

It is further suggested that the valve drive arrangement has a first gate structure and a second gate structure, which are provided to move the cam element in a first and a second direction. A compact valve drive arrangement can thereby be achieved in a particularly simple manner, especially if the shift element is provided to engage both gate structures.

The gate structures preferably have a common intersection point. An installation space of the valve drive arrangement can thereby be reduced further, as the gate structures intersect axially.

The gate structures are preferably designed in a symmetrical manner. An adjustment in both directions and an advantageous guide arrangement can be achieved thereby. Especially if the gate structures are designed in a mirror-symmetrical manner with regard to a circular line extending around the cam element, an advantageous guide arrangement with symmetrically acting forces and a simple arrangement of the gate structure can be achieved.

The invention will become more readily apparent from the following description of particular embodiments thereof on the basis of the accompanying drawings.

DESCRIPTION OF PARTICULAR EMBODIMENTS

Figure 1:
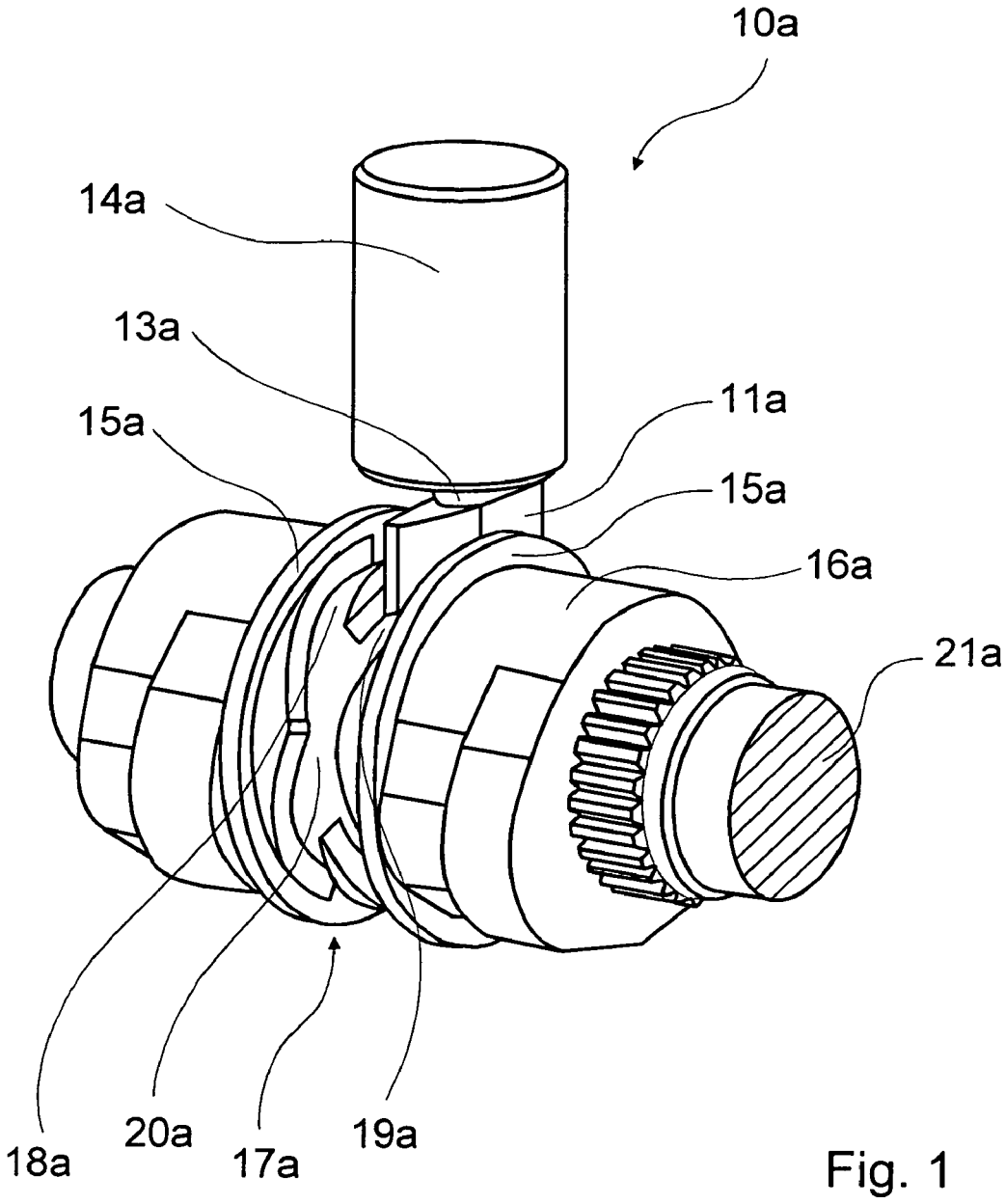
FIG. 1 shows a first embodiment of a valve drive arrangement in a perspective view.

FIG. 1 shows a first embodiment of a valve drive arrangement of an internal combustion engine. The valve drive arrangement has an axially movable cam element 16*a*, which is arranged in an axially movable manner on a camshaft 21*a*, whereby a shiftable valve drive arrangement is established. In order to axially move the cam element 16*a*, the valve drive arrangement has an actuator 10*a*, which has a shift element 11*a* and a gate structure 17*a* with two gate paths 18*a*, 19*a*.

The gate paths 18*a*, 19*a* have a negative profile. The cam element can be shifted by the actuator 10*a* in opposite directions as a result of a symmetrical arrangement of the gate paths 18*a*, 19*a*.

In order to shift from a first operating position of the cam element 16*a* to a second operating position, the shift element 11*a* engages the first gate path 18*a* via an engagement segment 22*a*. By means of a shift segment 23*a* of the gate path 18*a*, which has an axial direction component, a force acts on the cam element 16*a* in the axial direction as a result of a rotation of the cam shaft 21*a*. The cam element 16*a*, which is arranged in an axially movable manner on the camshaft 21*a*, is thereby moved axially. The shift element 11*a* is subsequently moved back into its starting position by a radially ascending groove base 25*a* of a disengagement segment 24*a* of the gate path.

In order to move the cam element 16*a* back into the first operating position, the shift element 11*a* engages the engagement segment 22*a* of the second gate path 19*a*. The cam element 16*a* is moved back into the first operating position by the axial direction component of the gate path of the following shift segment 23*a* of the second gate path 19*a*. The shift element 11*a* is subsequently moved back into its starting position by the radially ascending groove base of the disengagement segment 24*a*.

The first gate path 18*a* and the second gate path 19*a* are designed as intersecting gate paths 18*a*, 19*a* and have a common intersection point. In order to prevent that the shift element 11*a* changes in particular at the intersection point 20*a* from one gate path 18*a*, 19*a* to the other gate path 19*a*, 18*a*, the shift element has a rotationally asymmetrical basic shape.

The shift element 11*a* has a long main axis, which is in particular longer than a short secondary axis extending perpendicular to the main axis. The main axis and the secondary axis extend parallel to a support area, where the shift element is disposed on the groove base of the gate paths 18*a*, 19*a*. The short secondary axis has thereby a width which corresponds to a width of the gate paths 18*a*, 19*a*. The main axis is longer than the width of the gate paths 18*a*, 19*a*, whereby the sift element 11*a* is guided in the gate paths 18*a*, 19*a*.

The shift element 11*a* is thereby mounted in a rotational manner to an actuator 14*a* of the actuation device 10*a* by means of a shift element fastening device 13*a*. In order to prevent a rotation of the shift element 11*a* in an operating state, in which the shift element 11*a* is disposed out of engagement in the gate paths 18, 19, the gate structure 17*a* is provided with guide collars 15*a* arranged axially adjacent the gate paths 18*a*, 19*a*, which the shift element 11*a* abuts in such an operating state.

Figure 2:
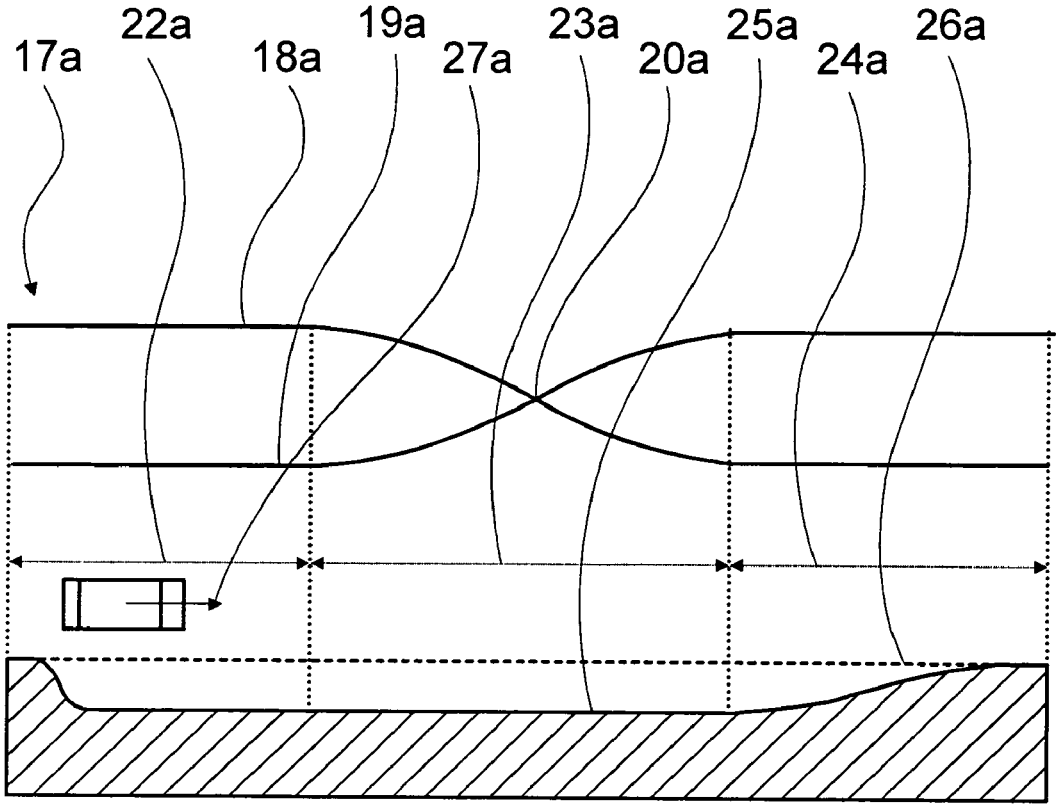
FIG. 2 is a schematic view of a switching gate of the valve device.

FIG. 2 schematically shows the arrangement of gate paths 18*a*, 19*a*. A lower region shows a depth of the gate paths 18*a*, 19*a*, an upper region schematically shows a pattern of the guide paths 18*a*, 19*a* on the cam element 16*a*.

In a first region, in which the engagement structure 22*a* of the gate paths 18*a*, 19*a* is disposed, the two gate paths essentially extend in the circumferential direction. The depth of the gate paths 18*a*, 19*a* increases over a short region of the engagement segment 22*a*. There is no step-like jump from one basic circle level 26*a* of the cam element 16 to a maximum depth, in order to avoid damage of the cam element 16*a* and/or of the switching element 11*a* during a faulty operation, where in particular the camshaft 21*a* rotates opposite to a provided rotational direction 27*a* with an engaged shift element 11*a*.

The depth of the gate paths 18*a*, 19*a* is essentially constant in a second region, in which the shift segment 23*a* of the gate paths 18*a*, 19*a* is present. By means of the axial direction components of the gate paths 18*a*, 19*a*, a force is exerted on the cam element 16*a* via the shift element 11*a* by the rotation of the cam element 16*a*, which force causes an axial movement of the cam element 16*a*. The shift element 11*a* is herein in axial engagement with the camshaft 21*a*.

In a third region, which is the disengagement segment 24*a* of the gate paths 18*a*, 19*a*, the depth of the gate paths 18*a*, 19*a* decreases over an area, which is in particular larger than the region of the engagement segment 22*a*, in which the depth increases. It is achieved thereby that a force acts on the shift element 11*a* by means of the rotation of the cam element 16*a*, which force is directed radially and by means of which the shift element 11*a* is pushed back to its starting position.

Figure 3:
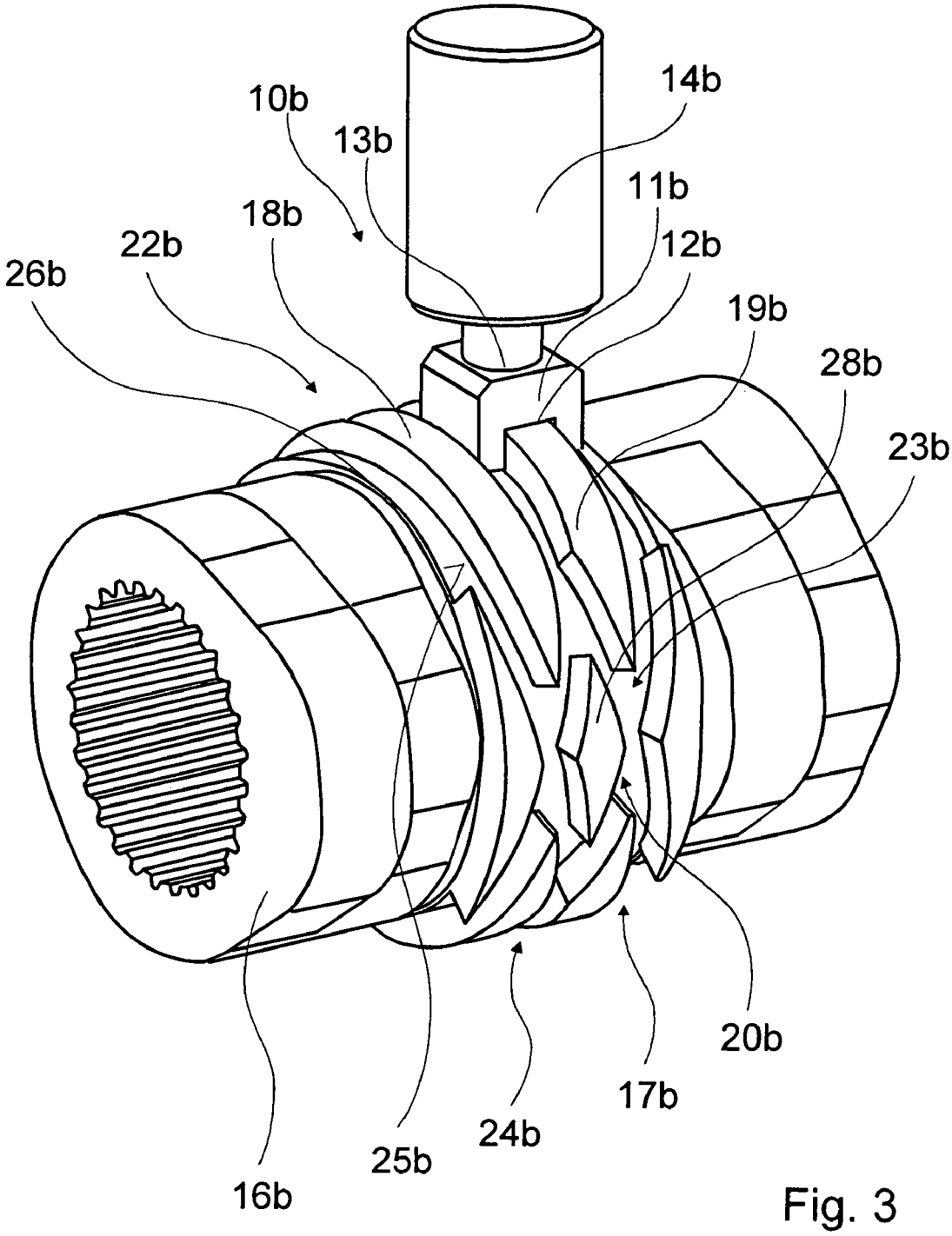
FIG. 3 shows a second embodiment of a valve drive arrangement in a perspective view.

FIG. 3 shows an alternative arrangement of a valve drive arrangement. For distinguishing the embodiments, the letter a in the reference numerals of the embodiment of FIGS. 1 and 2 is replaced by the letter b in the reference numerals of the embodiment shown in FIG. 3. The following description of FIG. 3 is essentially restricted to the differences of the embodiment shown in FIGS. 1 and 2, wherein one can refer to the description of FIGS. 1 and 2 with regard to the same components, characteristics and functions.

In contrast to the embodiment shown in FIGS. 1 and 2, FIG. 3 shows an embodiment with two gate paths 18*b*, 19*b* which have a positive profile. The gate path structures 18*b*, 19*b*, which also have an engagement structure 22*b*, a switching segment 23*b* and a disengagement segment 24*b*, are formed as intersecting gate paths 18*b*, 19*b* with a common intersection point 20*b*. An additional guide element 28*b* is arranged in the intersection point.

A shift element 11*b*, which can engage the gate paths 18*b*, 19*b* via the engagement structure 22*b*, has a rectangular basic shape. The shift element 11*b* further has a guide recess 12*b*, which is formed as a U-shaped guide groove and by means of which the shift element 11*b* can engage the gate paths 18*b*, 19*b* and move the cam element 16*b*. The shift element 11*b* can be shorter than the one of the first embodiment because of the additional guide element 28*b* at the point of intersection, which forms a center structure.

What is claimed is:

1. A valve drive arrangement for an internal combustion engine, including a camshaft (21*a*) with a cam element 16*a*, 16*b*) axially movably supported on the camshaft (21*a*) in a rotationally fixed manner, the cam element (16*a*, 16*b*) including a gate structure (17*a*, 17*b*) with two intersecting guide paths (18*a*, 19*a*; 18*b*, 19*b*) and an actuation device (10*a*; 10*b*) including an actuator (14*a*, 14*b*) with an engagement structure (13*a*, 13*b*) and a shift element (11*a*; 11*b*) for engagement with the gate structure (17*a*, 17*b*) for axially moving the cam element (16*a*; 16*b*), the shift element (11*a*; 11*b*) having a rotationally asymmetrical basic shape with a main axis extending in the direction of the guide paths having a length greater than the width of the guide paths for safely guiding the shift element (11*a*, 11*b*) along the guide paths and through the intersection of the guide paths.

2. The valve drive arrangement according to claim 1, wherein the shift element (11*b*) has an essentially rectangular basic shape.

3. The valve drive arrangement according to claim 1, wherein the shift element (11*b*) has a guide recess (12*b*), which is provided for engagement with the gate structure (17*b*).

4. The valve drive arrangement according to claim 1, including at least one guide collar (15*a*), for retaining the shift element (11*a*) in the gate structure area of the cam structure (17*a*).

5. The valve drive arrangement according to claim 1, wherein the shift element (11*a*, 11*b*) is provided to move the cam element (16*a*; 16*b*) in one of two opposite directions.

6. The valve drive arrangement according to claim 5, comprising a first gate path (18*a*; 18*b*) and a second gate path (19*a*; 19*b*), which are provided to move the cam element (16*a*; 16*b*) into a first and a second direction.

7. The valve drive arrangement according to claim 6, wherein the gate paths (18*a*, 19*a*; 18*b*, 19*b*) are designed in an axially symmetrical manner.

* * * * *